US011463794B1

(12) United States Patent
Guo

(10) Patent No.: US 11,463,794 B1
(45) Date of Patent: Oct. 4, 2022

(54) AUDIO INTELLIGENT WEARABLE DEVICE

(71) Applicant: Shenzhen Calion Power Co., Ltd, Shenzhen (CN)

(72) Inventor: Guanghuo Guo, Shenzhen (CN)

(73) Assignee: Shenzhen Calion Power Co., Ltd, Shenzhen (CN)

( * ) Notice: Subject to any disclaimer, the term of this patent is extended or adjusted under 35 U.S.C. 154(b) by 0 days.

(21) Appl. No.: 17/846,076

(22) Filed: Jun. 22, 2022

(51) Int. Cl.
*H04R 1/10* (2006.01)
*A42B 1/245* (2021.01)

(52) U.S. Cl.
CPC ..... *H04R 1/1033* (2013.01); *A42B 1/245* (2013.01); *H04R 1/1025* (2013.01); *H04R 1/1041* (2013.01); *H04R 2201/023* (2013.01)

(58) Field of Classification Search
CPC . H04R 1/00; H04R 1/02; H04R 1/028; H04R 1/10; H04R 1/1008; H04R 1/1025; H04R 1/1033; H04R 1/1041; H04R 1/105; H04R 1/1058; H04R 1/1066; H04R 1/1075; H04R 3/00; H04R 2201/023; A42B 1/04; A42B 1/041; A42B 1/08; A42B 1/24; A42B 1/245; A42B 1/242; A42B 1/1041
See application file for complete search history.

(56) References Cited

U.S. PATENT DOCUMENTS

| | | | | |
|---|---|---|---|---|
| 7,974,432 | B1 * | 7/2011 | Ryan | H04R 5/033 381/376 |
| 8,503,711 | B2 * | 8/2013 | Flynn | A42B 1/245 381/376 |
| 9,578,409 | B1 * | 2/2017 | Crockran, Jr. | A42B 1/241 |
| 2011/0219522 | A1 * | 9/2011 | Petitt | A42B 1/245 2/209.13 |
| 2017/0042270 | A1 * | 2/2017 | Chiang | H04R 1/025 |
| 2017/0251741 | A1 * | 9/2017 | Wang | H04R 5/0335 |

FOREIGN PATENT DOCUMENTS

| | | | | |
|---|---|---|---|---|
| CN | 104599690 A | | 5/2015 | |
| CN | 206182459 U | * | 5/2017 | A42B 3/303 |
| CN | 212909902 U | * | 4/2021 | |
| CN | 212911889 U | | 4/2021 | |
| CN | 213344499 U | | 6/2021 | |

* cited by examiner

*Primary Examiner* — Thang V Tran
(74) *Attorney, Agent, or Firm* — Nitin Kaushik

(57) ABSTRACT

The present disclosure discloses an audio intelligent wearable device, and relates to the technical field of outdoor apparels. The audio intelligent wearable device comprises a knitted hat, a fixed ring, a first shell and two earphone modules, wherein the fixed ring is inlaid on a front of the knitted hat, knitted pockets are sewn at two sides of the knitted hat symmetrically, the first shell is inlaid inside the fixed ring, and an earphone cable is arranged between the first shell and each of the earphone modules. According to the present disclosure, the earphone cables are stored by winding the earphone cables inside a winch through a cable storage mechanism so as to avoid the condition that when being exposed, the earphone cables are easily damaged, and meanwhile, the user experience can also be improved.

10 Claims, 15 Drawing Sheets

AUDIO INTELLIGENT WEARABLE DEVICE

TECHNICAL FIELD

The present disclosure belongs to the technical field of outdoor wearing, and particularly relates to an audio intelligent wearable device.

BACKGROUND

Knitted hats are portable and practical products deeply loved by young people, have many styles and beautiful colors and are necessary products for cold protection in winter. Bluetooth audio intelligent wearable device combines an audio receiving device with the knitted hat to achieve the purpose of effectively keeping warm through the knitted hat during listening to music.

For example, a knitted hat having earphones with the application number of CN202121796198.0 comprises a knitted beanie hat body. The knitted beanie hat body has earphone assembling cavities defined at two sides thereof, each of the earphone assembling cavities has a ring-shaped knitted edging defined at an opening thereof, and one earphone is arranged in each of the earphone assembling cavities at the two sides. The wireless Bluetooth earphones and the knitted hat are effectively combined; the earphone assembling cavities for storing the earphones are formed at the two sides of the knitted hat by using a weaving technology; the necking ring-shaped knitted edgings are formed at the openings of the cavities; and the earphones can be stored in the above-mentioned cavities, and meanwhile, a single earphone can also be taken out, and thus, the cleaning of the knitted cap is facilitated.

However, cables and earphone modules of an existing device cannot be stored, therefore, the earphone cables are likely to be excessively worn or stained in daily use, and dust easily enters into earphone modules. The existing device is relatively simple in a charging mode, and therefore, a new solution is proposed for solving the above problems.

SUMMARY

The present disclosure is aimed at providing an audio intelligent wearable device so as to solve existing problems that cables and earphone modules of an existing device cannot be stored, the existing device cannot be disassembled, water easily enters into the device to damage functions of internal electronic instruments during washing, and the existing device does not have a wireless charging function.

In order to solve the above technical problems, the present disclosure is implemented by the following technical solutions.

An audio intelligent wearable device, comprising: a knitted hat (1), a fixed ring (4), a first shell (5) and two earphone modules, wherein the fixed ring (4) is inlaid on a front of the knitted hat (1), knitted pockets (2) are sewn at two sides of the knitted hat (1) symmetrically and are used for placing second shells (8), the first shell (5) is inlaid inside the fixed ring (4), and an earphone cable (3) is arranged between the first shell (5) and each of the earphone modules;

a first compartment (38) is formed inside the first shell (5), a second compartment (39) is formed in a front of the first compartment (38), a third compartment (40) is formed in a front of the second compartment (39), a protective cover (6) is fixed on a front of the third compartment (40), the second compartment (39) comprises a fourth compartment (41), fifth compartments (42) and a sixth compartment (43), the fourth compartment (41) is located in the middle of the second compartment (39), the fifth compartments (42) are formed at two sides of the four compartment (41) symmetrically, and the sixth compartment (43) is located on a top of the fourth compartment 41; and a cable storage mechanism is arranged inside the first compartment (38), a control module is arranged inside the third compartment (40), the fifth compartments (42) are used for storing the earphone modules, and a wireless charging module is arranged inside the sixth compartment (43).

Further, wherein the cable storage mechanism comprises a fourth shell (22) and a third shell (20), the fourth shell (22) and the third shell (20) are both fixed on a back of an inner wall of the first compartment (38), the third shell (20) is located inside the fourth shell (22), a winch (21) is rotatably connected between the third shell (20) and the fourth shell (22), a spring (24) is arranged inside the third shell (20), one end of the spring (24) is fixedly connected to the third shell (20), the other end of the spring (24) is fixedly connected to the winch (21), and one end of each of the earphone cables (3) is located inside the four shell (22) and is fixedly connected to the winch (21).

Further, wherein each of the earphone modules comprises a second shell (8), a loudspeaker (23) is fixed at one end of the interior of the second shell (8), the second shell (8) has an anti-slip groove (25) defined at one side of one end thereof, a fastener (35) is arranged at one side of the second shell (8) and is located below the anti-slip groove (25), a follow-up block (10) is rotatably connected to one side of the second shell (8) and is located below the fastener (35), a first magnet (9) is fixed to the other side of the second shell (8), and the other end of each of the earphone wire (3) passes through the follow-up block (10) and the second shell (8) and is electrically connected to the loudspeaker (23).

Further, wherein a second magnet (30) is fixed at a position, corresponding to a first magnet (9), of an inner wall of each of the fifth compartments (42), magnetic poles of the first magnet (9) and the second magnet (30) are opposite, and a notch (36) communicating with each of the first compartments (38) is formed inside each of the fifth compartments (42).

Further, wherein a wireless charging module comprises a magnetic isolation sheet (27) and an earphone control main board (28), the magnetic isolation sheet (27) is fixed on a top of an inner side of the sixth compartment (43), a coil (26) is fixed on an upper surface of the magnetic isolation sheet (27), the earphone control main board (28) is fixed at a bottom of an inner wall of the sixth compartment (43), and the coil (26) and the earphone control main board (28) are electrically connected.

Further, wherein a square lithium battery (29) is fixed inside each of the fifth compartments (42), and the earphone control main board (28) is electrically connected to the square lithium batteries (29).

Further, wherein the control module comprises an earphone control PCB (37), a charging port (7) is welded at one side of the earphone control PCB (37), a control component is welded on a front of the earphone control PCB (37), and both the control component and the charging port (7) are electrically connected to the earphone control PCB (37), the control component comprises a previous button (11), a Bluetooth mode switching button (12), a next button (13), an FM audio receiving mode switching button (14), a play pause key (15), a volume up key (16), a power on-off control key (17), a volume down key (18) and a 2.4G audio mode switching button (19), both the earphone cables (3) and the earphone control main board (28) are electrically connected to the earphone control PCB (37), and the square lithium batteries (29) are electrically connected to the earphone control PCB (37).

Further, wherein the second compartment (39) further comprises a seventh compartment (44) which is located at a bottom of the fourth compartment (41), a wireless connection module is arranged inside the seventh compartment (44) and comprises a Bluetooth transmission module (31), an FM audio receiving transmission module (32), an 2.40 audio transmission module (33) and a fixed plate (34), the fixed plate (34) is fixed on a top of an inner wall of the seventh compartment (44), and the Bluetooth transmission module (31), the FM audio receiving transmission module (32), and the 2.4G audio transmission module (33) are sequentially fixed at a bottom of the fixed plate (34) and are all electrically connected to the earphone control PCB (37);

Further, wherein each of the second shells (8) is detachably arranged inside each of the fifth compartments (42) and is slidably connected to the interior of each of the fifth compartments (42), and the follow-up block (10) is slidably connected to the coil (26).

Further, wherein each of the second shells (8) is detachably clamped inside each of the knitted pockets (2).

Compared with the prior art, the present disclosure has the following beneficial effects:

(1) the earphone cables are stored by winding the earphone cables inside a winch, through a cable storage mechanism so as to avoid the condition that when being exposed, the earphone cables are easily damaged, and meanwhile the user experience can be improved; and (2) the device can be charged by various charging methods through a wireless charging module and a charging port, and thus, the portability of the device in use is improved; and earphone modules are stored inside fifth compartments, and thus, the earphone modules are effectively protected.

DETAILED DESCRIPTION OF THE EMBODIMENTS

Referring to FIG. 1 to FIG. 10, the present disclosure discloses audio intelligent wearable device.

Figure 1:
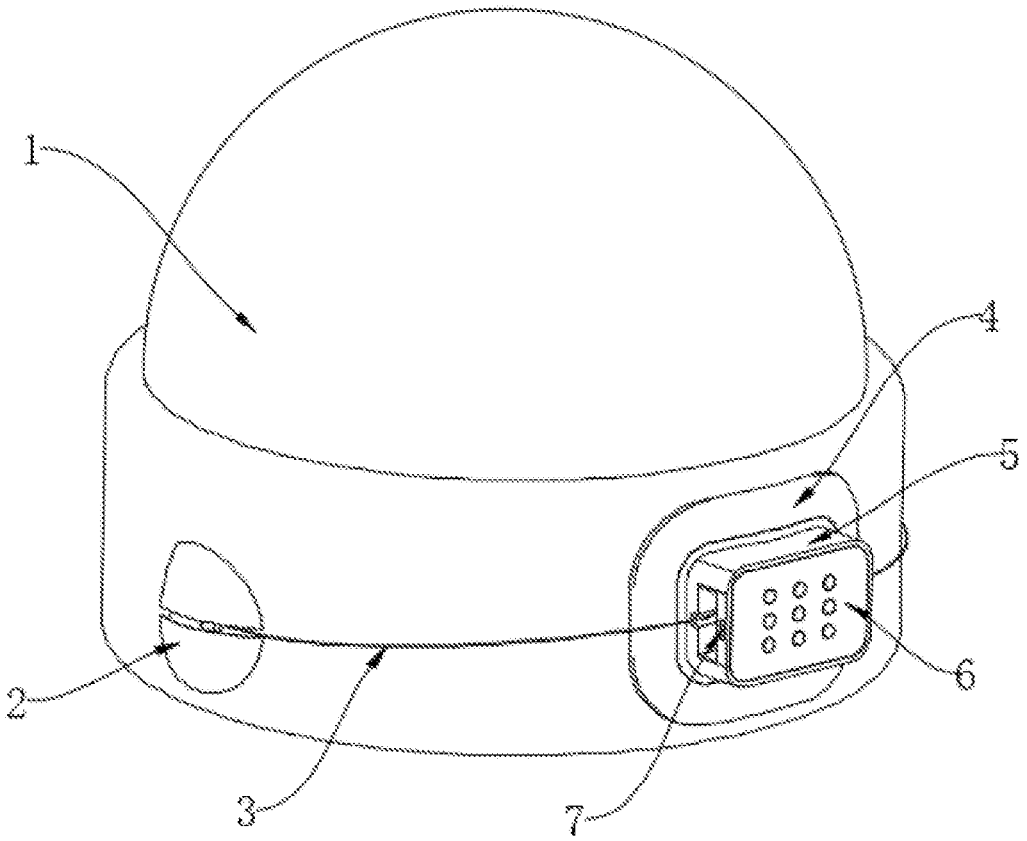
FIG. 1 is a schematic diagram of an overall structure of the present disclosure.
Figure 2:
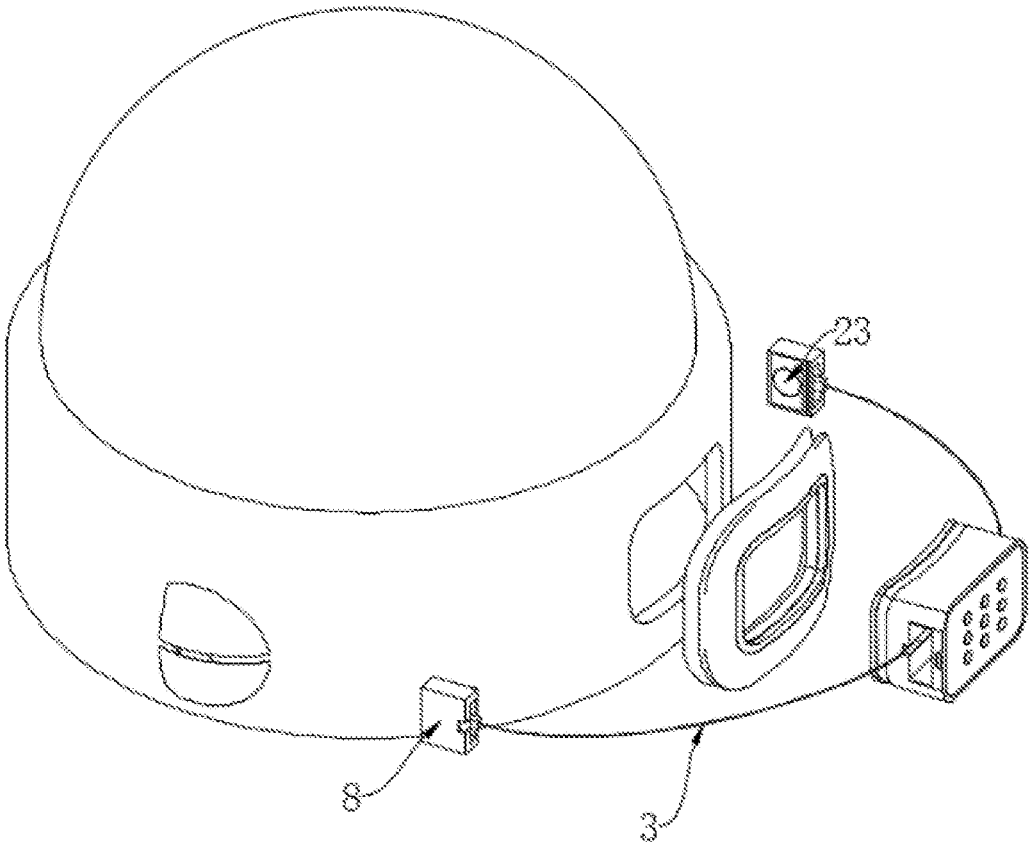
FIG. 2 is a schematic diagram of overall disassembled connection structures of the present disclosure.
Figure 3:
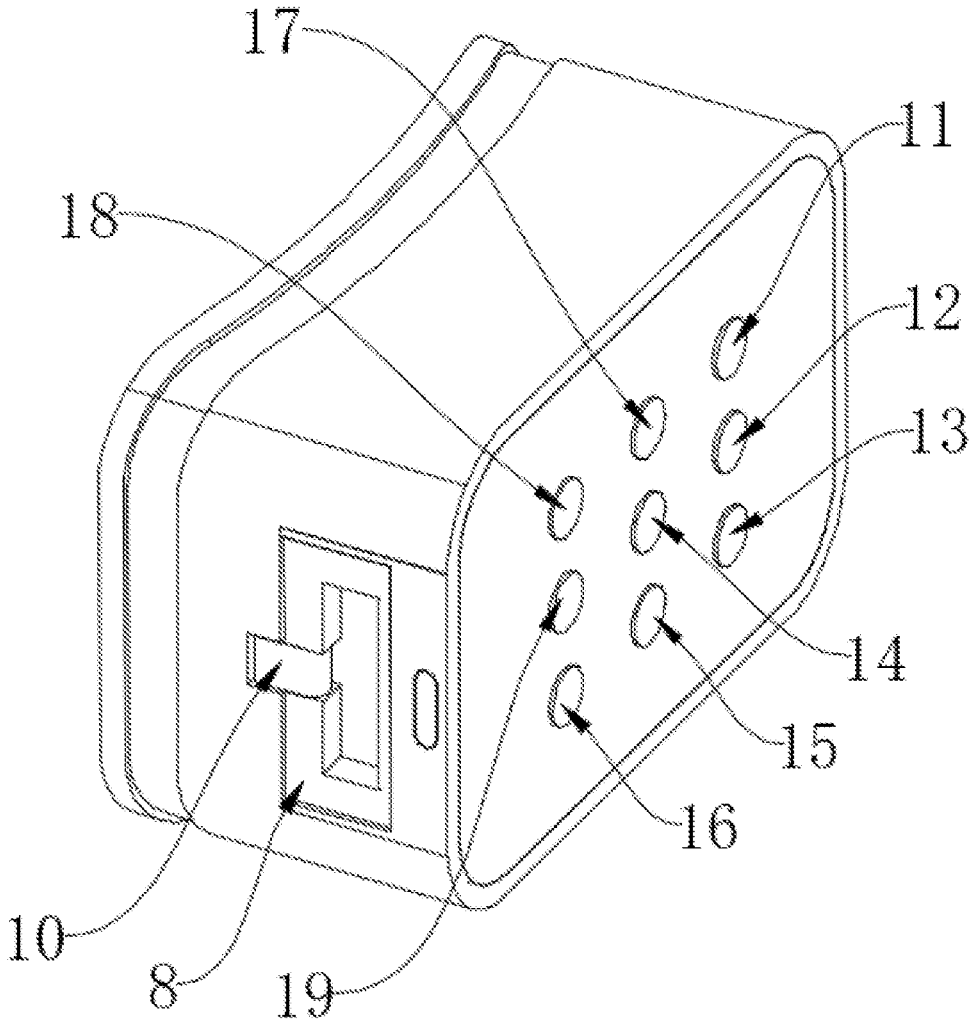
FIG. 3 is a schematic diagram of an overall connection structure of a first shell of the present disclosure.

Specially, referring FIG. 1 to FIG. 2, the audio intelligent wearable device comprises a knitted hat 1, a fixed ring 4, a first shell 5 and two earphone modules: the fixed ring 4 is inlaid on a front of the knitted hat 1 by sewing; knitted pockets 2 are sewn at two sides of the knitted hat 1 symmetrically; each of the knitted pockets 2 has a gap defined in the middle thereof, which is convenient for the disassembly and assembly of each of the earphone modules: the first shell 5 is detachably inlaid inside the fixed ring 4 which is made of a silica gel material: the first shell 5 has an annular groove defined at a position there of corresponding to the fixed ring 4; the fixed ring 4 is provided with an annular projection at a position corresponding to the annular groove; the first shell 5 is detachably inlaid inside the fixed ring 4 through the annular groove and the annular projection; each of earphone cables 3 is arranged between the first shell 5 and each of the earphone modules; and each of the earphone cables 3 is used for connecting each of the earphone modules to the first shell 5.

Referring to FIG. 4 to FIG. 7, in one embodiment, a first compartment 38 is formed inside the first shell 5, a second compartment 39 is formed in a front of the first compartment 38, a third compartment 40 is formed in a front of the second compartment 39, a protective cover 6 is fixed on a front of the third compartment 40 and is used for isolating an internal structure from the outside world, the second compartment 39 comprises a fourth compartment 41, fifth compartments 42 and a sixth compartment 43, the fourth compartment 41 is located in the middle of the second compartment 39, the fifth compartments 42 are formed at two sides of the four compartment 41 symmetrically, and the sixth compartment 43 is located on a top of the fourth compartment 41; and a cable storage mechanism is arranged inside the first compartment 38, and is used for storing the earphone cables 3, a control module is arranged inside the third compartment 40, the fifth compartments 42 are used for storing the earphone modules, and a wireless charging module is arranged inside the sixth compartment 43 and is used for wirelessly charging a square lithium battery 29.

Figure 4:
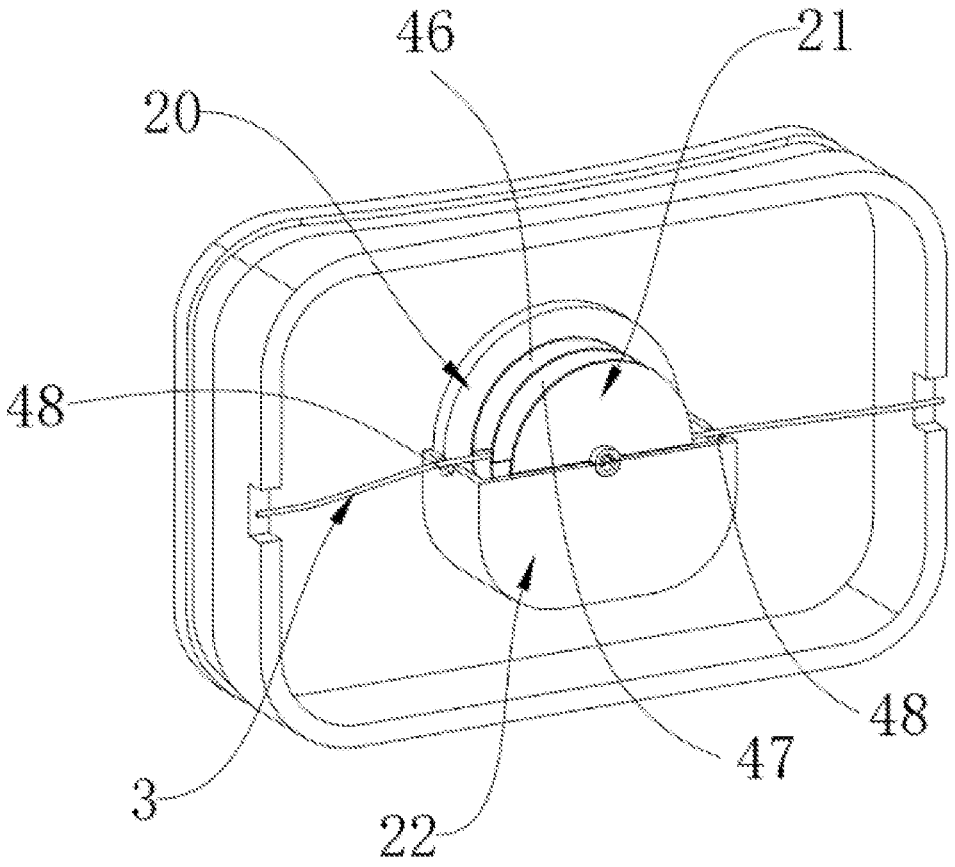
FIG. 4 is a schematic diagram of a connection structure inside a first compartment of the present disclosure.
Figure 5:
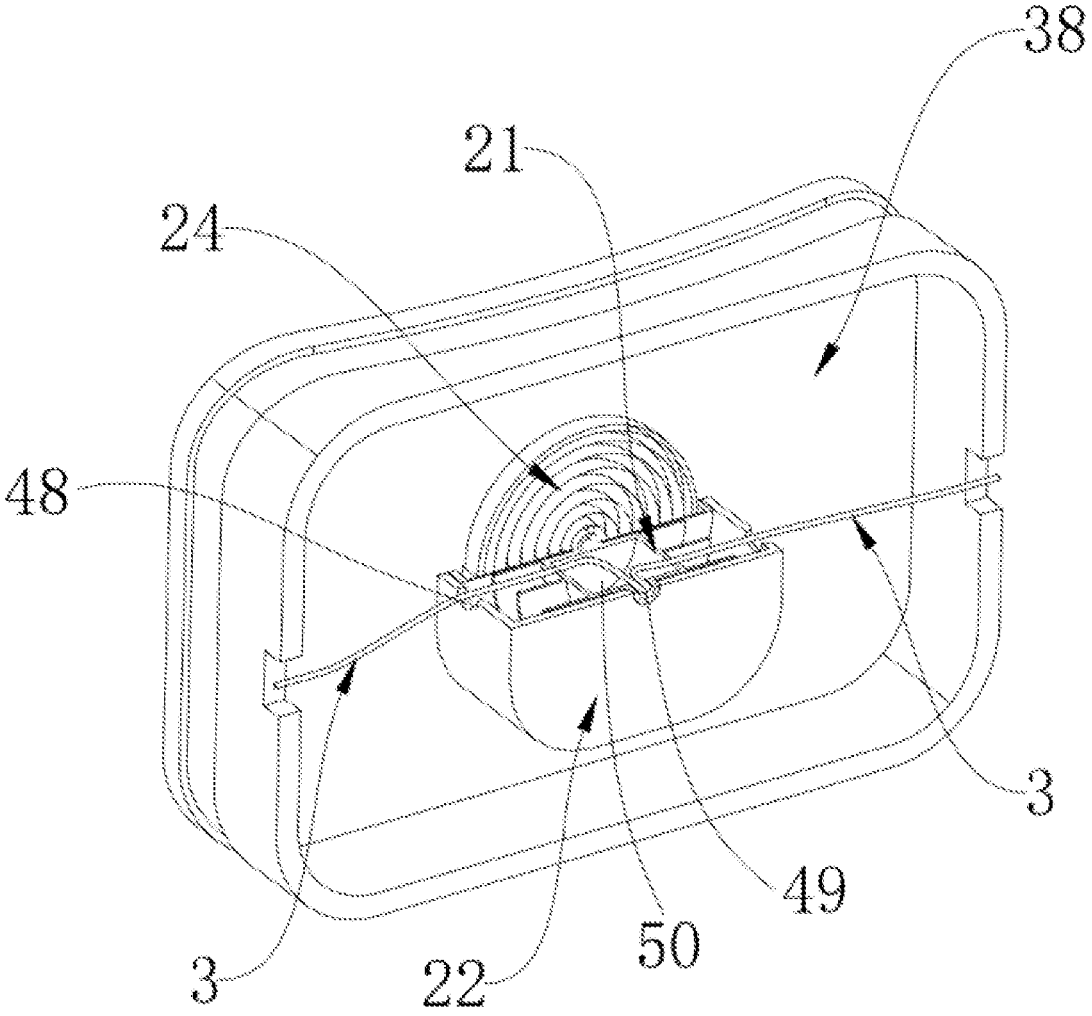
FIG. 5 is a schematic diagram of a connection structure of a cable storage mechanism of the present disclosure.

Referring to FIG. 4 to FIG. 5, in one embodiment, the cable storage mechanism comprises a fourth shell 22 and a third shell 20, the fourth shell 22 and the third shell 20 are both fixed on a back of an inner wall of the first compartment 38, the third shell 20 is located inside the fourth shell 22, a winch 21 is rotatably connected between the third shell 20 and the fourth shell 22, the fourth shell 22 is used for limiting the position of the winch 21, a spring 24 is arranged inside the third shell 20, the third shell 20 is used for limiting the position of the spring 24 so as to improve the running stability of the spring 24, one end of the spring 24 is fixedly connected to the third shell 20, the other end of the spring 24 is fixedly connected to the winch 21, one end of each of the earphone cables 3 is located inside the four shell 22 and is fixedly connected to the winch 21, when the earphone modules are put in the fifth compartments 42, the spring 24 exerts an elastic force on the winch 21 to rotate the winch 21, and the earphone cables 3 are stored by winding the earphone cables 3 inside the winch 21 so as to avoid the condition that when being exposed, the earphone cables are easily damaged, and meanwhile the user experience can be improved.

According to the present disclosure, the winch 21 has a helical wire groove thereon, the fourth shell 22 has two notches 48 thereon, the positions of which correspond to a headmost wire groove and a rearmost wire groove respectively, and the two notches 48 are distributed at two sides of the fourth shell 22. Taking a first wire groove 46 and a second wire groove 47 in FIG. 4 as an example, one of the notches 48 is located on a left side of the fourth shell 22 and directly faces the first wire groove 46, and one end of each of the earphone cables 3 penetrates into one of the notches 48, and then penetrates out of the other notch 48, so that the earphone cables 3 can be wound on the winch 21.

According to the present disclosure, after the earphone wire 3 penetrates through the notches 48 onto the winch 21, as shown in FIG. 5, the middle of the earphone wire is knotted to form a knotted part 49, so that the left and right parts of the earphone wire 3 have the same length, which is convenient for wearing, winding and stretching. The knotted part 49 is put in a hollow cavity 50 of the winch 21, so that the knotted part 49 (including during movement) can be restricted in the hollow cavity 50, and when the earphone cable 3 is stretched and wound, the earphone cable 3 can move along with the winch 21.

Figure 9:
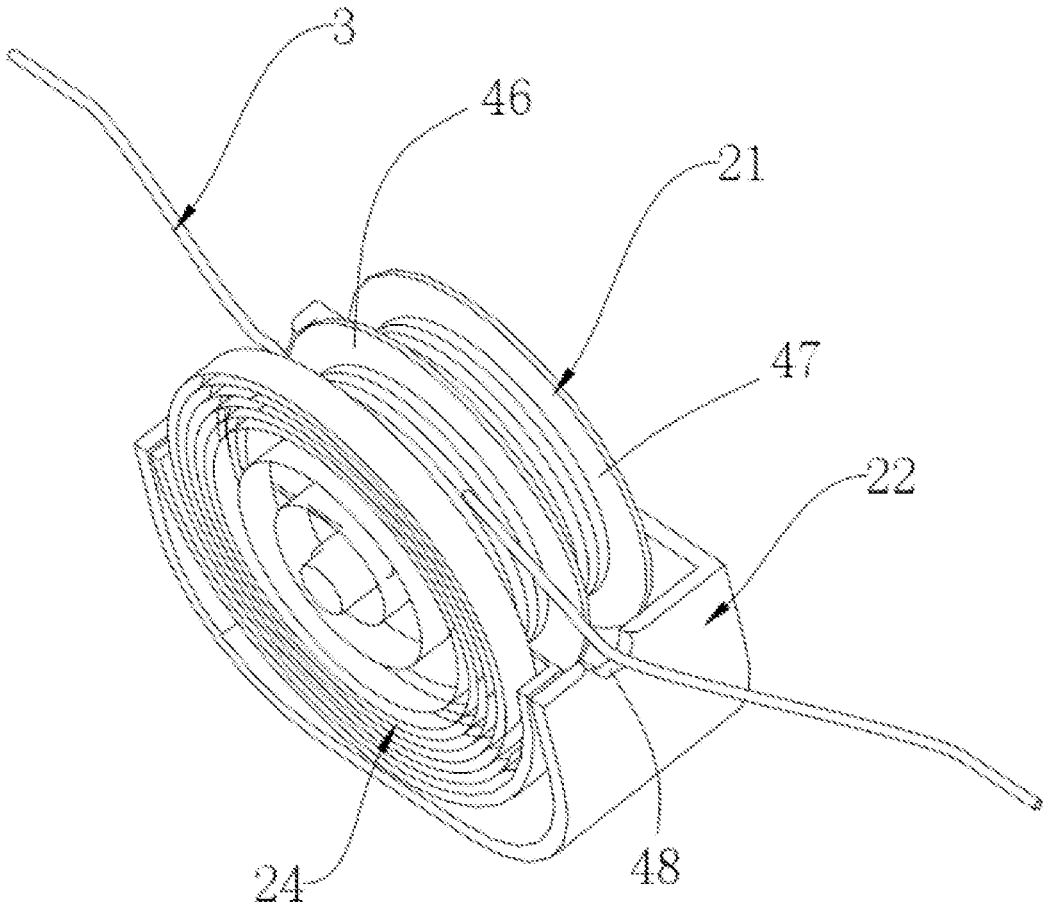
FIG. 9 is a diagram of a connection structure when earphone cables of the present disclosure are stored.

According to the present disclosure, the spring 24 is based on a tightly coiled sheet-shaped steel bar (also called a scroll spring), has elastic force after being wound tightly, and generates power when the spring 24 is gradually loosened by using the elastic force thereof, and thus, the winch 21 can be driven to rotate. As shown in FIG. 9, the earphone cable 3 is initially wound on the winch 21, and the earphone cable 3 is in a stored state at this time. When an earphone is needed, the earphone modules are taken out from the knitted pockets 2, then are pulled and worn; and when the earphone is not used, the earphone cable 3 is re-stored on the winch 21.

Figure 6:
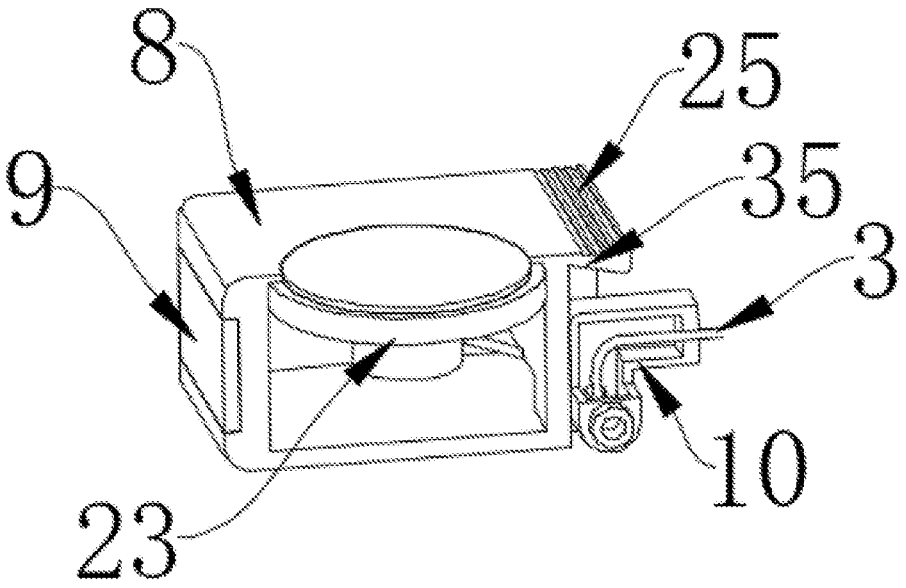
FIG. 6 is a schematic diagram of a connection structure inside a second shell of the present disclosure.

Referring to FIG. 6, in one embodiment, each of the earphone modules comprises a second shell 8, a loudspeaker 23 is fixed at one end of the interior of the second shell 8, the second shell 8 has an anti-slip groove 25 defined at one side of one end thereof, a fastener 35 is arranged at one side of the second shell 8 and is located below the anti-slip groove 25, and therefore, the second shell 8 can be conveniently taken out from the interior of each of the fifth compartments 42 through the anti-skid groove 25 and the fastener 35, a follow-up block 10 is rotatably connected to one side of the second shell 8 and is located below the fastener 35, a first magnet 9 is fixed at the other side of the second shell 8, the other end of the earphone wire 3 penetrates through the follow-up block 10 and the second shell 8 and is electrically connected to the loudspeaker 23; and when the second shell 8 is stored, the follow-up block 10 can avoid excessive wear caused by the too small bending angle of the earphone cable 3 during use, and thus, the service life of the device is effectively prolonged.

Figure 10:
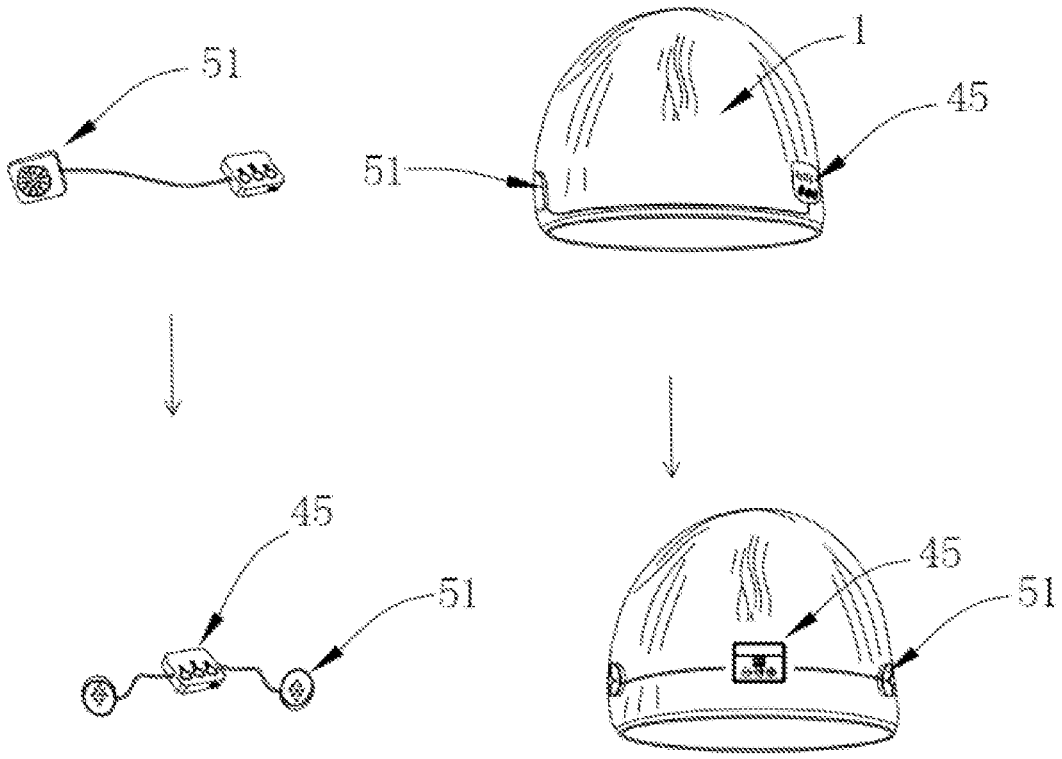
FIG. 10 is a schematic diagram of another shape of a knitted hat of the present disclosure.
Figure 11:
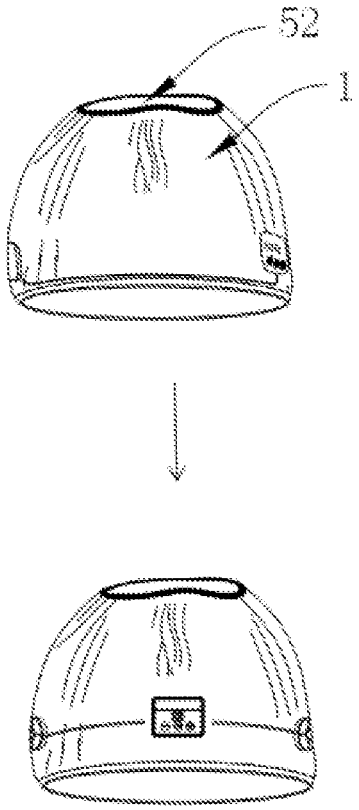
FIG. 11 is a schematic diagram I of another shape of the knitted hat of the present disclosure.
Figure 12:
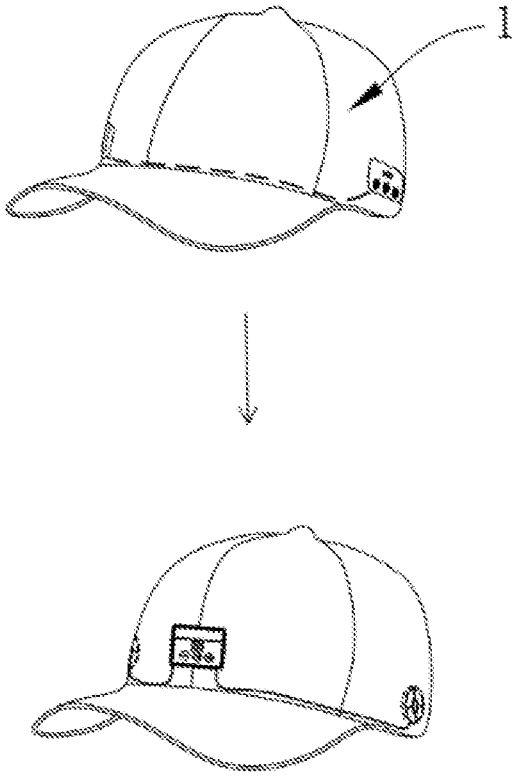
FIG. 12 is a schematic diagram II of another shape of the knitted hat of the present disclosure.
Figure 13:
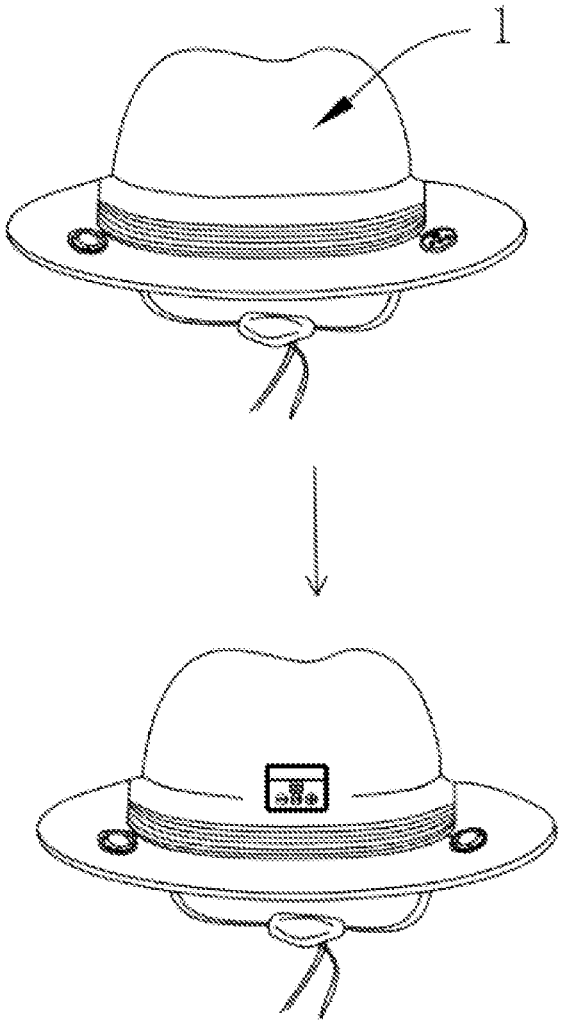
FIG. 13 is a schematic diagram II of another shape of the knitted hat of the present disclosure.
Figure 14:
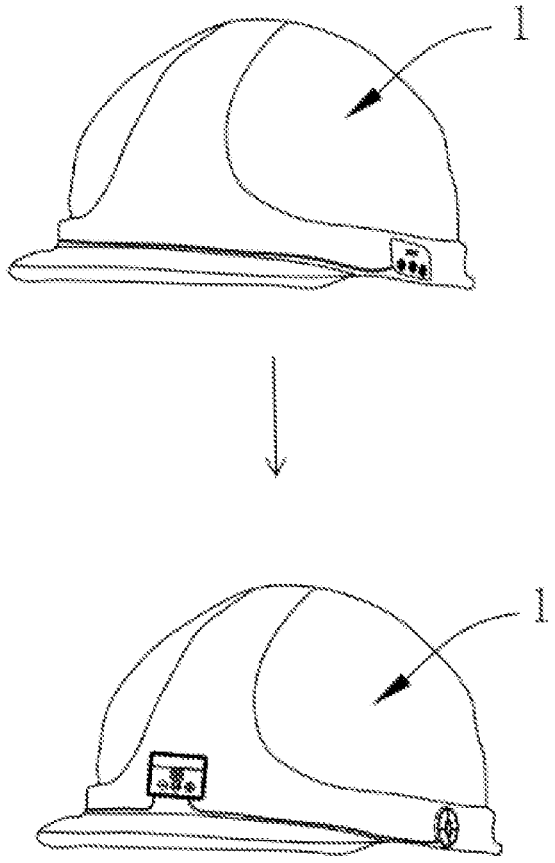
FIG. 14 is a schematic diagram IV of another shape of the knitted hat of the present disclosure.

As shown in FIG. 10, in the prior art, an audio, Bluetooth and FM combination component 45 is only simply placed on the knitted hat 1, which has problems that the earphone cable 3 is too long to be stored well and dust easily enters into the component.

Figure 7:
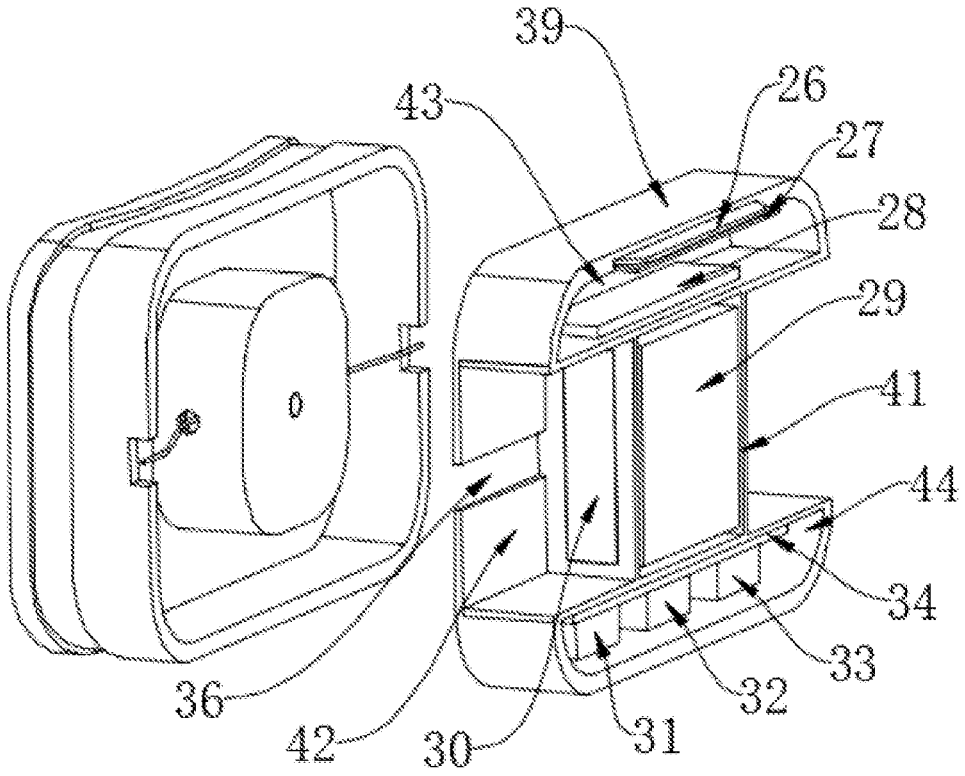
FIG. 7 is a schematic diagram of a connection structure inside a second compartment of the present disclosure.
Figure 8:
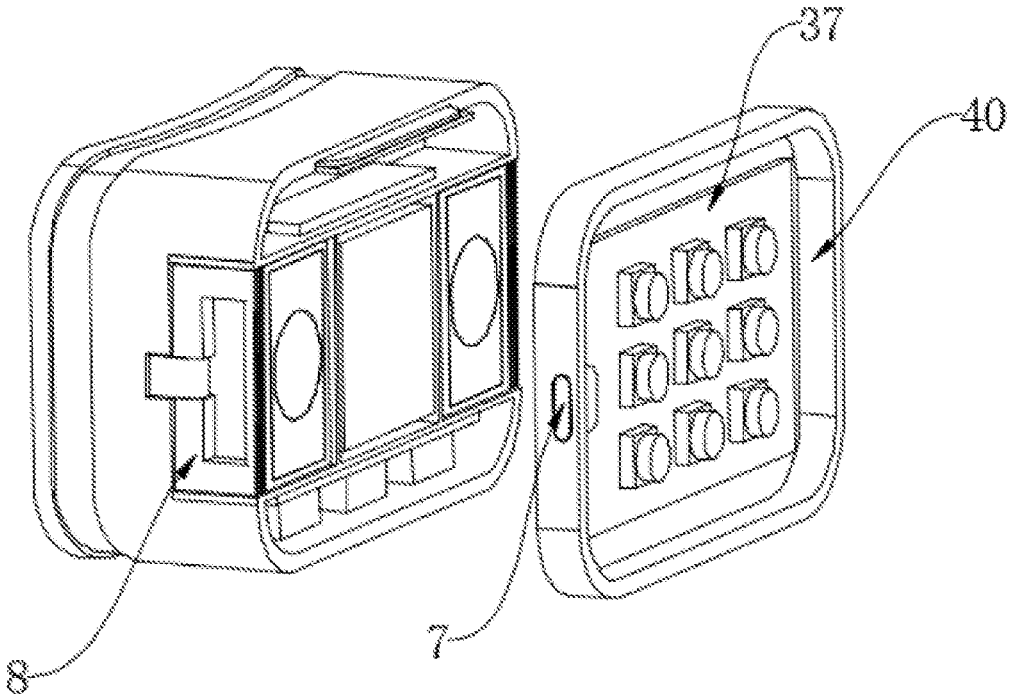
FIG. 8 is a schematic diagram of a connection structure inside a third compartment of the present disclosure.

Referring to FIG. 7 to FIG. 8, in one embodiment, a second magnet 30 is fixed at a position, corresponding to a first magnet 9, of an inner wall of each of the fifth compartments 42, magnetic poles of the first magnet 9 and the second magnet 30 are opposite, a notch 36 communicating with each of the first compartments 38 is formed inside each of the fifth compartments 42 and is used for penetration of the earphone wire 3;

a wireless charging module comprises a magnetic isolation sheet 27 and an earphone control main board 28, the magnetic isolation sheet 27 is fixed on a top of an inner side of the sixth compartment 43, a coil 26 is fixed on an upper surface of the magnetic isolation sheet 27, the magnetic isolation sheet 27 is used for isolating, fixing and cooling the coil 26, the earphone control main board 28 is fixed at a bottom of an inner wall of the sixth compartment 43, the coil 26 and the earphone control main board 28 are electrically connected, the earphone control main board 28 is used for driving and controlling the coil 26, and the coil 26 can play a role only through the drive and control of the earphone control main board 28;

a square lithium battery 29 is fixed inside each of the fifth compartments 42, the earphone control main board 28 is electrically connected to the square lithium batteries 29, the coil 26 and a wireless charging base receive an electric current from the wireless charging base through electromagnetic induction, and the electric current is integrated through the earphone control main board 28 to charge the square lithium batteries 29, and the wireless charging base is provided in the prior art, which will not be repeated here;

the control module comprises an earphone control PCB 37, a charging port 7 is welded at one side of the earphone control PCB 37, a control component is welded on a front of the earphone control PCB 37, and both the control component and the charging port 7 are electrically connected to the earphone control PCB 37, the charging port 7 is used for wired charging of the square lithium battery 29 through the earphone control PCB 37, the control component comprises a previous button 11, a Bluetooth mode switching button 12, a next button 13, an FM audio receiving mode switching button 14, a play pause key 15, a volume up key 16, a power on-off control key 17, a volume down key 18 and a 2.4 G audio mode switching button 19, both the earphone cables 3 and the earphone control main board 28 are electrically connected to the earphone control PCB 37, the square lithium batteries 29 are electrically connected to the earphone control PCB 37, the previous button 11 and the next button 13 are used for controlling the switching of songs through the earphone control PCB 37, the volume down key 18 and the volume up key 16 are used for controlling the volume of the earphone modules through the earphone control PCB 37, the play pause key 15 is used for controlling the playback and pause of the songs through the earphone control PCB 37, the power on-off control key 17 is used for controlling the power on and off of the device through the earphone control PCB 37, and the Bluetooth mode switching button 12, the FM audio receiving mode switching button 14 and the 24G audio mode switching button 19 are used for switching the functions of the wireless connection module through the earphone control PCB 37;

the second compartment 39 further comprises a seventh compartment 44 which is located at a bottom of the fourth compartment 41, the wireless connection module is arranged inside the seventh compartment 44 and comprises a Bluetooth transmission module 31, an FM audio receiving transmission module 32, an 2.4G audio transmission module 33 and a fixed plate 34, the fixed plate 34 is fixed on a top of an inner wall of the seventh compartment 44, and the Bluetooth transmission module 31, the FM audio receiving transmission module 32, and the 2.4G audio transmission module 33 are sequentially fixed at a bottom of the fixed plate 34 and are all electrically connected to the earphone control PCB 37; and Specifically, the Bluetooth transmission module 31 can switch to a connection mode by pressing the Bluetooth mode switching button 12 through the earphone control PCB 37, the FM audio receiving transmission module 32 can switch to a connection mode by pressing the FM audio receiving mode switching button 14 through the earphone control PCB 37, the 2.4G audio transmission module 33 can switch to a connection mode by pressing the 2.4G audio mode switching button 19 through the earphone control PCB 37, and the practicability of the device can be effectively improved through the switching of the multiple connection modes.

In one embodiment, each of the second shells 8 is detachably arranged inside each of the fifth compartments 42, and is slidably connected to the interior of each of the fifth compartments 42, the follow-up block 10 is slidably connected to the coil 26, when the earphone modules are stored, the earphone modules are inserted into the fifth compartments 42 and are fixed inside the fifth compartments 42 through the magnetic principle of the first magnet 9 and the second magnet 30, and thus, the storage of the earphone modules is realized.

In another embodiment.

Each of the second shells 8 is detachably clamped inside each of the knitted pockets 2, the earphone modules are taken out from the interiors of the fifth compartments 42 through the anti-skid grooves 25 and the fasteners 35 in practical use, and the earphone cables 3 are driven by the earphone modules to be pulled out from the interior of the cable storage mechanism by overcoming the elastic force of the spring 24, and can be used after the earphone modules are clamped inside the knitted pockets 2.

When in use, the first shell 5 is fixed inside the fixed ring 4, the earphone modules are taken out through the anti-skid grooves 25 and the fasteners 35, and are clamped inside the knitted pockets 2, when the device needs to be charged or the knitted pockets 1 are cleaned, the earphone modules are taken out from the interiors of the knitted pockets 2 and are put inside the fifth compartments 42, the earphone modules are fixed through the first magnet 9 and the second magnet 30 to prevent the earphone modules from falling off from the interiors of the fifth compartments 42, and meanwhile, the cable storage mechanism automatically stores the cable to prevent the cable from being worn and dust from entering the earphone modules.

Referring to FIG. 10 to FIG. 14, in one embodiment, the shape of the knitted hat 1 is slightly different from that in FIG. 1, and the knitted hat can be equipped with one or two earphones 51, and one or two audio, Bluetooth and FM combination components 45. The shape of the knitted hat 1 can be set according to the actual wearing situation. As shown in FIG. 1I, the knitted hat 1 has a top opening 52, and can be matched with a decorative part. The earphones 51 here are equivalent to the above-mentioned "the earphone modules".

Figure 15:
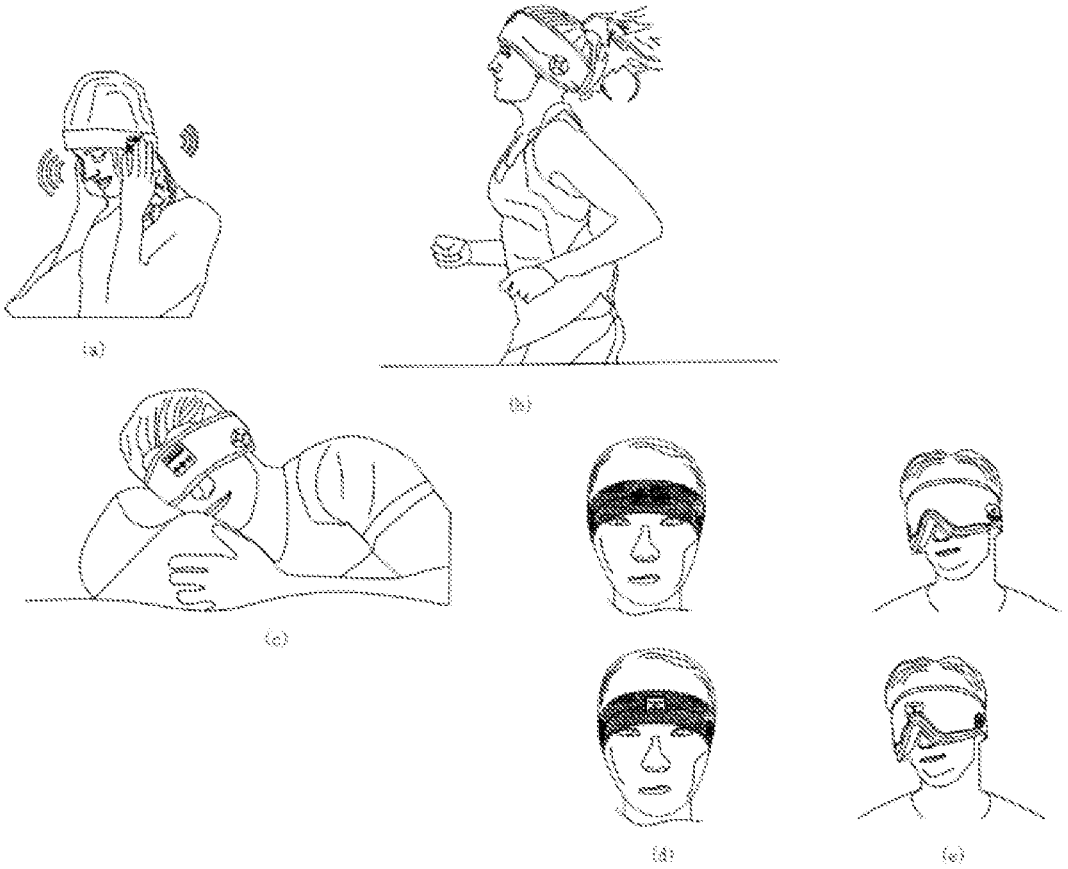
FIG. 15 is a schematic diagram of scenes where the knitted hat of the present disclosure is worn.

Referring to FIG. 15, in one embodiment, the knitted hat 1 of the present disclosure can be worn to realize listening to songs or FM radio in scenes such as running, resting and relaxing.

What is claimed is:

1. An audio intelligent wearable device, comprising: a knitted hat (1), a fixed ring (4), a first shell (5) and two earphone modules, wherein the fixed ring (4) is inlaid on a front of the knitted hat (1), knitted pockets (2) are sewn at two sides of the knitted hat (1) symmetrically and are used for placing second shells (8), the first shell (5) is inlaid inside the fixed ring (4), and an earphone cable (3) is arranged between the first shell (5) and each of the earphone modules;

a first compartment (38) is formed inside the first shell (5), a second compartment (39) is formed in a front of the first compartment (38), a third compartment (40) is formed in a front of the second compartment (39), a protective cover (6) is fixed on a front of the third compartment (40), the second compartment (39) comprises a fourth compartment (41), fifth compartments (42) and a sixth compartment (43), the fourth compartment (41) is located in the middle of the second compartment (39), the fifth compartments (42) are formed at two sides of the four compartment (41) symmetrically, and the sixth compartment (43) is located on a top of the fourth compartment 41; and a cable storage mechanism is arranged inside the first compartment (38), a control module is arranged inside the third compartment (40), the fifth compartments (42) are used for storing the earphone modules, and a wireless charging module is arranged inside the sixth compartment (43).

2. The audio intelligent wearable device according to claim 1, wherein the cable storage mechanism comprises a fourth shell (22) and a third shell (20), the fourth shell (22) and the third shell (20) are both fixed on a back of an inner wall of the first compartment (38), the third shell (20) is located inside the fourth shell (22), a winch (21) is rotatably connected between the third shell (20) and the fourth shell (22), a spring (24) is arranged inside the third shell (20), one end of the spring (24) is fixedly connected to the third shell (20), the other end of the spring (24) is fixedly connected to the winch (21), and one end of each of the earphone cables (3) is located inside the four shell (22) and is fixedly connected to the winch (21).

3. The audio intelligent wearable device according to claim 2, wherein each of the earphone modules comprises a second shell (8), a loudspeaker (23) is fixed at one end of the interior of the second shell (8), the second shell (8) has an anti-slip groove (25) defined at one side of one end thereof, a fastener (35) is arranged at one side of the second shell (8) and is located below the anti-slip groove (25), a follow-up block (10) is rotatably connected to one side of the second shell (8) and is located below the fastener (35), a first magnet (9) is fixed to the other side of the second shell (8), and the other end of each of the earphone wire (3) passes through the follow-up block (10) and the second shell (8) and is electrically connected to the loudspeaker (23).

4. The audio intelligent wearable device according to claim 3, wherein a second magnet (30) is fixed at a position, corresponding to a first magnet (9), of an inner wall of each of the fifth compartments (42), magnetic poles of the first magnet (9) and the second magnet (30) are opposite, and a notch (36) communicating with each of the first compartments (38) is formed inside each of the fifth compartments (42).

5. The audio intelligent wearable device according to claim 4, wherein a wireless charging module comprises a magnetic isolation sheet (27) and an earphone control main board (28), the magnetic isolation sheet (27) is fixed on a top of an inner side of the sixth compartment (43), a coil (26) is fixed on an upper surface of the magnetic isolation sheet (27), the earphone control main board (28) is fixed at a bottom of an inner wall of the sixth compartment (43), and the coil (26) and the earphone control main board (28) are electrically connected.

6. The audio intelligent wearable device according to claim 5, wherein a square lithium battery (29) is fixed inside each of the fifth compartments (42), and the earphone control main board (28) is electrically connected to the square lithium batteries (29).

7. The audio intelligent wearable device according to claim 6, wherein the control module comprises an earphone control PCB (37), a charging port (7) is welded at one side of the earphone control PCB (37), a control component is welded on a front of the earphone control PCB (37), and both the control component and the charging port (7) are electrically connected to the earphone control PCB (37), the control component comprises a previous button (11), a Bluetooth mode switching button (12), a next button (13), an FM audio receiving mode switching button (14), a play pause key (15), a volume up key (16), a power on-off control key (17), a volume down key (18) and a 2.4G audio mode switching button (19), both the earphone cables (3) and the earphone control main board (28) are electrically connected to the earphone control PCB (37), and the square lithium batteries (29) are electrically connected to the earphone control PCB (37).

8. The audio intelligent wearable device according to claim 7, wherein the second compartment (39) further comprises a seventh compartment (44) which is located at a bottom of the fourth compartment (41), a wireless connection module is arranged inside the seventh compartment (44) and comprises a Bluetooth transmission module (31), an FM audio receiving transmission module (32), an 2.4G audio transmission module (33) and a fixed plate (34), the fixed plate (34) is fixed on a top of an inner wall of the seventh compartment (44), and the Bluetooth transmission module (31), the FM audio receiving transmission module (32), and the 2.40 audio transmission module (33) are sequentially fixed at a bottom of the fixed plate (34) and are all electrically connected to the earphone control PCB (37).

9. The audio intelligent wearable device according to claim 8, wherein each of the second shells (8) is detachably arranged inside each of the fifth compartments (42) and is slidably connected to the interior of each of the fifth compartments (42), and the follow-up block (10) is slidably connected to the coil (26).

10. The audio intelligent wearable device according to claim 8, wherein each of the second shells (8) is detachably clamped inside each of the knitted pockets (2).

* * * * *